US007632318B2

(12) United States Patent
Stephanos

(10) Patent No.: US 7,632,318 B2
(45) **Date of Patent: *Dec. 15, 2009**

(54) LIGHTER FLUID COMPOSITION

(76) Inventor: Prodromos Pericles Stephanos, 1255 Juanita Dr., Walnut Creek, CA (US) 94595

( * ) Notice: Subject to any disclaimer, the term of this patent is extended or adjusted under 35 U.S.C. 154(b) by 672 days.

This patent is subject to a terminal disclaimer.

(21) Appl. No.: 11/036,646

(22) Filed: Jan. 14, 2005

(65) Prior Publication Data

US 2005/0120618 A1 Jun. 9, 2005

Related U.S. Application Data

(63) Continuation of application No. 09/756,597, filed on Jan. 5, 2001, now Pat. No. 6,843,812.

(51) Int. Cl.
*C10L 7/00* (2006.01)

(52) U.S. Cl. ..... 44/266; 44/302

(58) Field of Classification Search ..... 44/266, 44/301, 302

See application file for complete search history.

(56) References Cited

U.S. PATENT DOCUMENTS

| | | | | |
|---|---|---|---|---|
| 4,829,897 | A * | 5/1989 | Wyman et al. | 101/483 |
| 5,494,611 | A * | 2/1996 | Howe | 510/242 |
| 5,676,763 | A * | 10/1997 | Salisbury et al. | 134/22.12 |
| 6,843,812 | B2 * | 1/2005 | Stephanos | 44/266 |

FOREIGN PATENT DOCUMENTS

| | | | |
|---|---|---|---|
| CA | 865065 | * | 8/1967 |
| JP | 05117691 A | * | 5/1993 |
| JP | 06299112 | * | 10/1994 |
| JP | 3140588 | * | 3/2001 |

* cited by examiner

*Primary Examiner*—Cephia D Toomer
(74) *Attorney, Agent, or Firm*—Temmerman Law Office; Mathew J. Temmerman

(57) ABSTRACT

A lighter fluid composition usable for starting barbecues and the like that comprises naturally occurring combustible materials, which is clean burning and results in low volatile organic compound (VOC) emission during combustion, which is biodegradable and easily disposable, and which burns with a pleasant aroma and does not impart any unpleasant hydrocarbon odor or flavor to food cooked on a barbecue. The composition preferably comprises between approximately 0.5 weight percent and approximately 90 weight percent of a terpene or terpenoid oil, and between approximately 0.5 weight percent and approximately 98.5 weight percent of short chain alcohol, between approximately 0.5 weight percent and approximately 60 weight percent of water, between approximately 0.1 weight percent and approximately 10 weight percent of surfactant, and between approximately 0.5 weight percent and approximately 10 weight percent of thickening agent. The preferred terpene preferably comprises d-limonene or a citrus derived oil containing d-limonene such as cold-pressed orange oil. The preferred alcohols are methanol and ethanol. The preferred surfactant is a non-ionic detergent or detergents, and the preferred thickener is a pH controllable slightly cross-linked polyacrylic acid material.

5 Claims, No Drawings

LIGHTER FLUID COMPOSITION

RELATED APPLICATIONS

This application is a continuation in part of U.S. application Ser. No. 09/756,597, filed Jan. 5, 2001 now U.S. Pat. No. 6,843,812.

BACKGROUND OF THE INVENTION

1. Field of the Invention

This invention pertains generally to lighter fluids and combustible liquids for use in starting barbecues, cooking fires and the like. More specifically, the invention is a clean burning lighter fluid composition and method which utilizes naturally occurring combustibles to provide for low volatile organic hydrocarbon (VOC) emission and a pleasant aroma during combustion.

2. Description of the Background Art

Outdoor cooking and the use of barbecues have long been popular activities. In order to facilitate the starting and combustion of cooking fires and barbecues, numerous ignition or "lighter" fluid compositions have been developed. The lighter fluid typically comprises a flammable hydrocarbon mixture which is spread over a bed of porous charcoal pieces and allowed to soak or penetrate into the porous charcoal. After suitable time for penetration of the fluid, the charcoal bed is ignited, and the lighter fluid is allowed to combust and burn away to leave a bed of coals suitable for cooking. Solid igniter compositions are also known, and typically comprise pieces of wax or hydrocarbon-impregnated material which is mixed with charcoal and ignited.

The presently known lighter fluid compositions for barbecue use have some important deficiencies. Lighter fluids generally present a safety risk associated with fire, and many lighter fluid compositions that provide a low flash point for easy ignition present a risk of fire and burns to users.

Another well known and pervasive problem with lighter fluids is the presence of a residual hydrocarbon odor which can permeate or otherwise affect the food cooked on the barbecue such that an unpleasant hydrocarbon odor and taste is imparted to the food. This problem arises from the nature of the hydrocarbon materials used in many lighter fluid composition. The hydrocarbon materials are petrochemical derived and often contain low volatility hydrocarbon, aromatic, and polycyclic aromatic compounds which do not fully combust, and thus can leave a residue on or around the charcoal which unpleasantly "flavors" the food that is subsequently cooked on the barbecue.

More recently, the emissions from the combustion of lighter fluids have become an important consideration. Large urban areas increasingly make efforts to prevent deterioration of air quality, and in many locations regulations are in place, or are being considered, which will effect outdoor cooking and the use of lighter fluids. Typical lighter fluid compositions result in substantial emission of volatile organic compounds or "VOCs" during combustion, and, because of these emissions, the use of many conventional lighter fluids may be limited or even banned in some regions.

There is accordingly a need for a lighter fluid composition and method which minimizes safety hazards associated with lighter fluid ignition, which does not leave an unpleasant hydrocarbon residue which affects the quality of barbecue-cooked food, which burns cleanly with low VOC emission, and which can be used in geographic areas subject to strict air quality control regulations. The present invention satisfies these needs, as well as others, and generally overcomes the deficiencies found in the back ground art.

SUMMARY OF THE INVENTION

The invention is a lighter fluid composition usable for starting barbecues and the like that comprises naturally occurring combustible materials, which is clean burning and results in low volatile organic compound (VOC) emission during combustion, which is biodegradable and easily disposable, and which burns with a pleasant aroma and does not impart any unpleasant hydrocarbon odor or flavor to food cooked on a barbecue. In general terms, the composition of the invention comprises between approximately 0.5 weight percent and approximately 90 weight percent of a terpene or terpenoid oil, and between approximately 0.5 weight percent and approximately 98.5 weight percent of short chain alcohol. Preferably, the composition of the invention further comprises of between approximately 0.5 weight percent and approximately 60 weight percent of water. The composition preferably further comprises between approximately 0.1 weight percent and approximately 10 weight percent of surfactant, and between approximately 0.1 weight percent and approximately 10 weight percent of thickening agent.

The preferred terpene preferably comprises d-limonene, a citrus derived oil containing d-limonene such as cold pressed orange oil, or mixtures or admixtures thereof. Non-citrus-derived natural and synthetic terpenes and/or terpenoids may alternatively be substituted in whole or in part for the d-limonene and/or citrus oil. The citrus derived terpenes generally impart a pleasant fragrance to the lighter fluid composition.

The preferred alcohols preferably are C1-C3 alcohols such as methanol, ethanol, and isopropanol, or mixtures or admixtures thereof. Various other low molecular weight alcohols may be substituted in whole or in part for the above alcohols. Methanol and ethanol are inexpensive and clean burning, and provide enhanced ignition properties to the composition. Methanol is presently preferred for reason of good ignition properties and low emission, as related further below.

The preferred surfactant is a non-ionic polymeric surfactant, long chain alcohol esters, or mixtures or admixtures thereof. Various ionic surfactants are also usable with the invention, and may be used with, or in place of, the non-ionic surfactants.

The use of water in the composition provides an easy and inexpensive way to control the ignition characteristics of the composition, and, with the surfactant, helps emulsify the terpene liquid within the composition.

The preferred thickening agent preferably comprises a partially or lightly cross-linked ionic polymer or copolymer which undergoes pH controllable thickening in solution. The preferred thickening agents comprise lightly cross-linked polyacrylic acid homopolymers and copolymers. The thickening agent reduces vapor pressure and helps control the ignition characteristics of the composition, and also helps stabilize the emulsion present in the composition. With the additon of the thickening agent, the present invention may constitute an emulsion.

By way of example, and not necessarily of limitation, the lighter fluid composition of the invention preferably comprises between approximately 10 weight percent and approximately 45 weight percent of terpene or terpenoid, between approximately 20 weight percent and approximately 70 weight percent of short chain alcohol, between approximately 10 weight percent and approximately 40 weight percent of water, between approximately 0.05 weight percent and approximately 5 weight percent of surfactant, and between approximately 1 weight percent and approximately 8 weight percent of thickening agent.

More preferably, the lighter fluid composition of the invention comprises between approximately 20 weight percent and approximately 35 weight percent of terpene or terpenoid, between approximately 30 weight percent and approximately 50 weight percent of short chain alcohol, between approximately 20 weight percent and approximately 30 weight percent of water, between approximately 0.1 weight percent and approximately 2 weight percent of surfactant, and between approximately 2 weight percent and approximately 6 weight percent of thickening agent.

Still more preferably, the lighter fluid composition of the invention comprises between approximately 30 weight percent and approximately 43 weight percent of d-limonene or cold press orange oil, between approximately 30 weight percent and approximately 40 weight percent of methanol, between approximately 20 weight percent and approximately 26 weight percent of water, between approximately 0.1 weight percent and approximately 2 weight percent of surfactant, and between approximately 3 weight percent and approximately 5 weight percent of thickening agent.

In formula ting the composition of the invention, the desired amount of terpene liquid is measured and transferred to a stirring container, and the surfactant is added to and stirred with the terpene. The desired amount of alcohol is then added to the stirred terpene and surfactant. In a separate container, the desired amount of water is measured, and the thickening agent is added to the watered and stirred therewith. The combined water and thickening agent are then slowly added to the stirring mix of terpene, surfactant and alcohol until fully blended. Once fully mixed, a neutralizing agent is added to the mix to bring the pH of the mix or solution to a desired value for optimal thickening. A bittering agent may be added to the mix to prevent children, infants or animals from inadvertently ingesting the composition.

The invention also provides a method for igniting a barbecue which comprises generally providing a lighter fluid of the composition described above, agitating the composition prior to use in order to maintain an emulsion in the composition, pouring the lighter fluid composition over charcoal, igniting the composition on the charcoal, and allowing the lighter fluid and charcoals to burn until a bed of hot coals suitable for cooking is achieved.

An object of the invention is to provide a lighter fluid composition which is clean burning and exhibits low VOC emission during combustion.

Another object of the invention is to provide a lighter fluid composition which is easy and inexpensive to manufacture.

Another object of the invention is to provide a lighter fluid composition which has a pleasant aroma and does not impart an unpleasant hydrocarbon taste or smell to barbecue-cooked food.

Another object of the invention is to provide a lighter fluid composition with good fire safety characteristics and easy ignitability.

Another object of the invention is to provide a lighter fluid composition which utilizes naturally occurring combustible materials.

Another object of the invention is to provide a lighter fluid composition which is biodegradable and easily disposable.

Further objects and advantages of the invention will be brought out in the following portions of the specification, wherein the detailed description is for the purpose of fully disclosing the preferred embodiment of the invention without placing limitations thereon.

DETAILED DESCRIPTION OF THE PREFERRED EMBODIMENTS

The invention is a clean burning lighter fluid composition and method that uses naturally occurring, biodegradable combustible materials which advantageously provides low volatile organic compound (VOC) emission during combustion. The lighter fluid composition of the invention, when used for barbecues and cooking fires, does not impart an unpleasant hydrocarbon odor or taste to cooked food.

The combustible materials used in the composition of the invention may be a naturally occurring terpene or terpene oil, and a short chain or low molecular weight alcohol. Any terpene may be used., including straight and branched terpenes and terpenoid compounds in either purified form or present in natural oils derived from fruit, tree bark, seeds, nuts or other natural sources. The presently preferred terpenes for use with the invention are citrus derived d-limonene and citrus oils such as cold pressed orange oil, lemon oil, lime oil, grapefruit oil or the like. Cold pressed orange oil, which is the presently preferred terpene oil for use with the invention, is a natural oil derived from pressed orange peel. The term "terpene" as used herein is intended to encompass d-limonene, the above citrus oils, as well as any other naturally occurring or synthetic terpene or terpenoid oil or mixtures or admixtures thereof. Folded citrus oil is considered to be a terpene. Thus, for instance, folded orange oil is considered to be a type of orange oil.

Orange oil is a relatively inexpensive, commercially available terpene oil which typically comprises about 90 percent by weight of d-limonene, together with natural fragrances and color. D-limonene and orange oil impart a pleasant aroma to the composition of the invention, and are presently preferred over other terpenes for use with the invention. The orange oil additionally provides a slight orange color to the composition. The terpene in the lighter fluid composition of the invention will generally comprise between approximately 0.5 weight percent and approximately 90 weight percent, and more preferably between approximately 10 weight percent and approximately 45 weight percent, and still more preferably between approximately 20 weight percent and approximately 40 weight percent.

Generally, any short chain or low molecular weight alcohol may be used as a combustible material for the present invention, with various C1-C3 alcohols being preferred, and with methanol, ethanol and isopropanol being more preferred due to their relatively low cost. Methanol and ethanol inexpensive, readily available, and can be derived from natural sources. Presently, methanol is the preferred alcohol for use with the invention due to low cost, clean burning, and enhancement of ignition. The alcohol used in the lighter fluid composition of the invention will generally comprise between approximately 0.5 weight percent and approximately 98.5 weight percent of the composition, and will more preferably comprise between approximately 20 weight percent and approximately 70 weight percent, and most preferably comprise between approximately 30 weight percent and approximately 50 weight percent.

In some embodiments of the invention, various aliphatic hydrocarbon materials may be used together with, or in place of, the aforementioned alcohol, as a combustible ingredient. Such aliphatic hydrocarbon materials may comprise, for example, any C1-C12 straight chain, cyclic or branched alkane and alkene hydrocarbons, or mixtures or admixtures thereof. In these embodiments, conventional high boiling "petroleum ether" or "naphtha" was employed in formulations where a hydrocarbon liquid was used partially or entirely in place of alcohol. The term "aliphatic hydrocarbons" as used herein is intended to encompass all of the hydrocarbon materials noted above.

Water is preferably used in the lighter fluid composition of the invention to help the ignition characteristics of the composition and to provide a basis for maintaining an emulsion when used with an emulsifier as described below. The emulsion nature of the composition of the invention allows for quick and inexpensive preparation or manufacture of the composition. Water also serves as an inexpensive extender which increases the weight and volume of the composition. Generally, water will comprise between approximately 0.5 weight percent and approximately 60 weight percent of the composition, and more preferably comprise between approximately 10 weight percent and approximately 40 weight percent, and most preferably comprise between approximately 20 weight percent and approximately 30 weight percent.

In order to form the aforementioned emulsion, a suitable surfactant or emulsifier may be used with the composition of the invention. The preferred surfactants are non-ionic polymeric surfactants, "natural oil" esters such as palm oil and castor oil ethoxylates, long chain "detergent range" alcohol esters, or mixtures or admixtures thereof. One presently preferred surfactant is E-Z-MULSE.RTM., which is commercially available from Florida Chemical Co., noted above. E-Z-MULSE.RTM. comprises a mixture of propylene glycol, castor oil ethoxylates, and detergent range alcohol ethoxylates. E-Z-MULSE.RTM. has been particularly effective at forming good emulsions of citrus oil, alcohol and water formulations in accordance with the invention. The specific examples described below utilize E-Z-MULSE.RTM. as a surfactant, which was used as received from Florida Chemical Co.

Various other surfactants are also suitable for use with the present invention, including low molecular weight polyethylene glycols (PEG), polysorbate materials, and ionic surfactant materials. Generally, the surfactant will comprise between approximately 0.05 weight percent and approximately 10 weight percent of the composition, and more preferably between approximately 0.1 weight percent and approximately 5 weight percent, and most preferably comprise between approximately 0.5 weight percent and approximately 3 weight percent.

A thickener or thickening agent is preferably used with the composition of the invention. The use of a thickening agent allows control of the vapor pressure, and hence the ignition characteristics, of the composition. The thickening agent also helps stabilize the emulsion. The thickener further helps prevent the composition from penetrating into barbecue charcoals prior to ignition, which allows the composition to completely bum off during combustion and avoids the formation of residual, unburned hydrocarbon material which can result in undesirable odor and flavor in the barbecue-cooked food. The use of a thickener as provided by the invention additionally helps control the application of the lighter fluid mix to charcoals by minimizing splattering of the lighter fluid, which reduces the fire hazard and prevents waste of the lighter fluid.

A variety of thickeners can be used with the invention, including polymeric and cellulosic materials and fumed silicas. The preferred thickeners are ionic polymers which allow pH-controllable thickening. Most preferable are lightly cross-linked polyacrylic acid homo- and co-polymers. The presently preferred thickeners are CARBOPOL.RTM. polymers available from BF Goodrich Co. of Akron Ohio. The CARBOPOLs.RTM are high molecular weight polyacrylic acid based polymers which are lightly cross-linked using allyl sucrose and/or allylpentaerythritol. Thickening of CARBOPOLs.RTM. in solution is typically achieved by adjusting the pH to a neutral or slightly alkaline pH. More specifically, CARBOPOL AQUA 30.RTM. is presently preferred as a thickening agent for the lighter fluid composition of the invention. In the specific examples described below, the thickener CARBOPOL AQUA 30.RTM. was used as received from BF Goodrich, and 18 percent aqueous sodium hydroxide (NaOH) was used for pH adjustment. Aqueous methylamine or other alkylamine may also be used for pH control, but is less preferred. Generally, the thickener will comprise between approximately 0.5 weight percent and approximately 10 weight percent of the composition, and more preferably between approximately 2 weight percent and approximately 8 weight percent, and most preferably comprise between approximately 3 weight percent and approximately 6 weight percent.

The following specific examples describe the preparation and composition of some of the presently preferred embodiments of the lighter fluid composition of the invention. Variations on the following examples will suggest themselves to those skilled in the art upon review of this disclosure, and such variations are considered to be within the scope of this disclosure. Thus, the particular details in the examples below are only exemplary, and should not be considered limiting.

The cold pressed orange oil and d-limonene used in the specific examples below are commercially available from Florida Chemical Co. of Winter Haven, Fla., and were used as received therefrom. Suitable orange oil for use with the invention is also commercially available from Cargill Inc., of Minneapolis, Minn. The alcohol used in the specific examples below was technical grade methanol, commercially available from ARCH Chemicals, Inc. and used as received. The product E-Z-MULSE.RTM. was used as a surfactant as received from Florida Chemical Co. The thickener used was CARBOPOL AQUA 30.RTM. as received from BF Goodrich. Commercial de-ionized water was used, although filtered water and tap water may be used as well.

EXAMPLE 1

Approximately 45 ml of d-limonene (approximately 37.8 g or 42.9% weight) was added to a 250 ml beaker. Approximately 1 g of E-Z-MULSE.RTM. (approximately 1.1% weight) was slowly added to the d-limonene and the mix was stirred to disperse or dissolve the E-Z-MULSE.RTM. While stirring, approximately 35 ml (approximately 28 g or 31.8% weight) of methanol was added to the stirring d-limonene and E-Z-MULSE.RTM. In a separate 100 ml beaker, approximately 20 ml (approximately 20 g or 22.7% weight) water was added together with approximately 1.3 g (approximately 1.5% weight) of CARBOPOL AQUA 30.RTM., and the water and CARBOPOL AQUA 30.RTM. were mixed together. The combined water and CARBOPOL AQUA 30.RTM. was then slowly added to the stirring mix of d-limonene, methanol and E-Z-MULSE.RTM. The combined mix was briefly stirred to provide an emulsion or solution having a pH of approximately 6.5 as determined a CHECKERS pH meter by Hanna Instruments, Inc. of Woonsocket R.H. The pH of the mix was adjusted to 7.5 by dropwise addition of 18% aqueous sodium hydroxide (approximately 15 drops) while stirring. The mix thickened upon pH adjustment.

The mix is storable indefinitely, and the emulsion is stable for several days. During storage the emulsion will de-stabilize, and the water will undergo phase separation. Thus, after storage, the mix should be briefly shaken, stirred, or otherwise re-agitated prior to use so that the mix is returned to an emulsion prior to use.

EXAMPLE 2

Approximately 40 ml of cold pressed orange oil (approximately 33.8 g or 38% weight) was slowly mixed with approximately 0.8 g of E-Z-MULSE.RTM. (approximately 0.1% weight) in the same manner described in Example 1. Approximately 40 ml (approximately 32 g or 36% weight) of methanol was then added to the stirring orange oil and E-Z-MULSE.RTM. Approximately 20 ml (approximately 20 g or 22.9% weight) water was mixed together with approximately 2.7 g (approximately 3% weight) of CARBOPOL AQUA 30.RTM. in a separate container, and the combined water and CARBOPOL AQUA 30.RTM. was slowly added to the stirring mix of orange oil, methanol and E-Z-MULSE.RTM. The combined mix was briefly stirred to provide an emulsion having a pH of approximately 6.5, and the pH of the mix was adjusted to 7.5 by dropwise addition of 18% aqueous sodium hydroxide as described above. The resulting emulsion had a slight orange color and orange odor imparted by the orange oil. The emulsion was stable for several days before phase separation of the water occurred, and the mix was re-agitated prior to use to restore it to an emulsion.

EXAMPLE 3

In this example, approximately 33 ml of cold-pressed orange oil (approximately 27.8 g or 30.6% weight) was slowly mixed with approximately 0.5 g of E-Z-MULSE.RTM. (approximately 0.1% weight) in the manner related above, followed by addition, with stirring, of approximately 45 ml (approximately 36 g or 39.7% weight) of methanol. In a separate container, approximately 22 ml (approximately 22 g or 24.2% weight) water was mixed with approximately 4.5 g (approximately 5% weight) of CARBOPOL AQUA 30.RTM. The combined water and CARBOPOL AQUA 30.RTM. was slowly added to the stirring mix of orange oil, methanol and E-Z-MULSE.RTM. as described above, and the combined mix was briefly stirred to provide an emulsion with a slight orange color and orange aroma. The solution was pH adjusted to 7.5 by dropwise addition of 18% aqueous sodium hydroxide as described above. The resulting emulsion was stable for several days, and, after storage, the mix was re-agitated prior to use to restore it to an emulsion.

EXAMPLE 4

In this example, the lighter fluid composition of Example 3 (approximately 30.6 weight % of orange oil, 0.1 weight % of E-Z-MULSE.RTM., 39.7 weight % of methanol, 24.2 weight % of water, and 5 weight % of CARBOPOL AQUA 30.RTM.) was tested for emission rate during combustion. The tests were carried out in accordance with Rule 1174, "Ignition Method Compliance Certification Protocol" of the South Coast Air Quality Management District (SCAQMD). The SCAQMD Rule 1174 is well known in the art as it applies to ignition of barbecues, and the Rule imposes strict limitations on the emission of volatile organic compounds (VOC) from lighter fluids before such materials may be supplied, offered for sale or sold within the District. Rule 1174 certification for a lighter fluid requires that VOC emissions resulting from the ignition of barbecue charcoal be less than or equal to 0.020 pound per start.

The tests in this example were carried out by Horizon Air Measurement Services, Inc. of Newbury Park Calif., an independent testing laboratory approved by SCAQMD for Rule 1174 testing. All testing was performed using the equipment and procedures described in detail in the "Rule 1174 Ignition Method Compliance Certification Protocol". Six replicate test runs were completed on the lighter fluid composition, plus a field blank and an ambient air sample on the lighter fluid composition. Additionally, six replicate test runs, plus an ambient and blank sample, were conducted for Kingsford charcoal briquettes, lot no. M40170 (Springfield plant), to determine baseline briquette emissions. The test results for the lighter fluid composition are outlined in Table 1 and Table 2, which respectively show the stack gas characteristics, volatile organic compound (VOC) emissions. The baseline test results for the briquettes are provided in Table 3 and Table 4, which respectively show the stack gas characteristics and VOC emissions.

TABLE 1

STACK GAS CHARACTERISTICS (LIGHTER FLUID)

| | Sample 1 | Sample 2 | Sample 3 | Sample 4 | Sample 5 | Sample 6 | Average |
|---|---|---|---|---|---|---|---|
| Temp. F. | 92.4 | 93.5 | 94.6 | 96.4 | 92.9 | 90.9 | 94 |
| velocity afm | 442 | 464 | 451 | 447 | 434 | 455 | 449 |
| velocity sfm | 441 | 463 | 450 | 446 | 433 | 454 | 448 |
| flow rate dscfm | 222 | 232 | 225 | 223 | 218 | 229 | 225 |

TABLE 2

VOC EMISSIONS (LIGHTER FLUID)

| | Sample 1 | Sample 2 | Sample 3 | Sample 4 | Sample 5 | Sample 6 | Average |
|---|---|---|---|---|---|---|---|
| Conc., ppm (avg. of duplicate samples) | 142 | 109 | 92.2 | 128 | 90.2 | 118.0 | 113.0 |

TABLE 2-continued

| VOC EMISSIONS (LIGHTER FLUID) | | | | | | | |
|---|---|---|---|---|---|---|---|
| | Sample 1 | Sample 2 | Sample 3 | Sample 4 | Sample 5 | Sample 6 | Average |
| Emission rate, lb VOC/ Start (lb. VOC is expressed as "$CH_2$" | 0.0284 | 0.0234 | 0.00188 | 0.00257 | 0.0181 | 0.0246 | 0.0232 |

The field blank QA/QC sample for the lighter fluid runs was 9.30 ppm, and the ambient run was 25.5 ppm of VOC.

TABLE 3

| STACK GAS CHARACTERISTICS (BRIQUETTE BASELINE) | | | | | | | |
|---|---|---|---|---|---|---|---|
| | Sample 1 | Sample 2 | Sample 3 | Sample 4 | Sample 5 | Sample 6 | Average |
| Temp. F. | 85.4 | 87.3 | 91.5 | 91.2 | 88.9 | 87.7 | 94 |
| velocity, afm | 459 | 454 | 448 | 460 | 443 | 463 | 453 |
| velocity, sfm | 456 | 452 | 446 | 458 | 431 | 462 | 451 |
| flow rate, dscfm | 233 | 229 | 225 | 231 | 218 | 234 | 228 |

TABLE 4

| VOC EMISSIONS (BRIQUETTE BASELINE) | | | | | | | |
|---|---|---|---|---|---|---|---|
| | Sample 1 | Sample 2 | Sample 3 | Sample 4 | Sample 5 | Sample 6 | Average |
| Conc., ppm (avg. of duplicate samples) | 73.5 | 55.8 | 72.0 | 63.7 | 60.5 | 46.6 | 62.0 |
| Emission rate, lb VOC/ Start (lb. VOC is expressed as "$CH_2$" | 0.01587 | 0.0115 | 0.0146 | 0.0135 | 0.0120 | 0.0099 | 0.0129 |

The field blank QA/QC sample for the briquette base line runs was 5.1 ppm, and the ambient run was 12.5 ppm of VOC.

The SCAQMD Rule 1174 requires a VOC emission rate of no greater than 0.020 lb VOC/Start. The average VOC emission rate for the lighter fluid runs in Table 2 is 0.0232 lb VOC as CH.sub.2 per start. The average VOC emission rate for the briquette baseline runs in Table 4 is 0.0129 lb VOC as CH.sub.2 per start. According to the Rule 1174 protocol composition was determined by (0.0232 lb VOC/Start)−(0.0129 lb VOC/Start)+(0.008 lb VOC/Start) to give a Rule 1174 emission rate of 0.0183 lb VOC/Start. As can be seen from the above, the lighter fluid composition provided of the invention is clean burning and meets stringent SCAQMD requirements which are used in the Los Angeles Calif. region, which is one of the strictest regions in the world regarding air quality. The lighter fluid composition of the invention may thus be used for barbecue cooking in regions where prior art lighter fluid compositions are or will be banned by increasingly stringent air quality regulations.

The compositions described in the above examples were also prepared using ethanol or isopropanol, instead of methanol, to provide compositions with substantially the same properties noted above.

Various additional materials may be added to the composition of the invention. For example, several samples, based on the above examples, were prepared wherein a small amount (approximately 50 ppm) of BITREX.RTM. bittering agent was added. BITREX.RTM. is a well known additive used to impart an unpleasant taste to liquids in order to prevent or discourage young children, infants and animals from inadvertently ingesting a harmful liquid. A variety of colorants and scents may also be used with the composition to alter its color and aroma.

The use of a water emulsion in the lighter fluid composition of the invention allows easy and economical manufacture, and helps control the ignition characteristics of the composition to reduce fire hazard. The polymeric thickener helps stabilize the emulsion prior to applying the composition to charcoal, and further helps control the ignition characteristics of the composition. In particular, the use of a thickening agent in accordance with the invention helps the composition to completely burn off during combustion by preventing the composition from penetrating into the charcoal during and after application of the lighter fluid composition. The use of a thickener also helps control the application of the lighter fluid mix to charcoals by minimizing splattering of the lighter fluid, as noted above. The methanol or other short chain alcohol provide an inexpensive combustible material which is generally odorless, clean burning, and amenable to the emulsive nature of the composition.

The use of orange oil as a combustible provides a pleasant aroma and color to the composition. Citrus oils and d-limonene are attractive because they are natural oils, but are generally recognized as materials which provide a sooty, dirty combustion, and would typically not be considered for use as a clean burning fuel which meets the rigorous SCAQMD standards. The combination of citrus oil, methanol and water, together with a surfactant and thickener, as provided by the invention, overcomes the sooty nature associated with citrus oil combustion to provide a clean burning composition. The overall lighter fluid composition of the invention is biodegradable and disposable as a biodegradable product.

In some embodiments of the invention, aliphatic hydrocarbon was used in place of the alcohol, in whole or in part to provide a slightly different variation in the composition. Sample compositions prepared as described above, with a high boiling petroleum ether used in place of methanol, also worked well as clean burning fire starting liquids. The primary difference in preparing the composition with an aliphatic hydrocarbon was that more vigorous mixing or agitation was required to form an emulsion. Compositions were prepared in which the alcohol portion of the composition was replaced in varying degrees with aliphatic hydrocarbon, with the emulsion stability predictably decreasing as the amount of aliphatic hydrocarbon was increased at the expense of the alcohol. However, even where the composition utilized an aliphatic hydrocarbon entirely in place of alcohol, agitation of the composition resulted in an emulsion sufficiently long-lived for use as a lighter fluid.

In further embodiments of the invention which utilize aliphatic hydrocarbon to replace the alcohol in whole or in part, the water, surfactant, and thickening agent may be omitted, so that the lighter fluid comprises a terpene together with aliphatic hydrocarbon. In this manner, a lighter fluid is provided which is more purely hydrocarbon in nature, but which has the pleasant aroma and, in the case of orange oil, a pleasant color as well. The ratio of terpene to hydrocarbon may vary according to the particular properties desired, and but the range may include less than 0.01% terpene (such as orange oil) by weight, with the remainder being hydrocarbon. Indeed, in this embodiment, the percentage of terpene may vary from less than 0.01% to 2.0% or higher. For instance, the terpene percentage may 0.5% or 0.1% or 0.01%. Hydrocarbon materials usable for lighter fluids may in some instances contain some aromatic hydrocarbons, as well as aliphatic hydrocarbon. Thus, while aliphatic hydrocarbon is preferred, the term "aliphatic hydrocarbon" as used herein is intended to encompass hydrocarbon materials which also contain aromatic hydrocarbon. In one embodiment, mineral spirits may be used as the aliphatic hydrocarbon. The applicant conducted the following experiment with the following results: in a beaker, the applicant slowly stirred in from 0.01% to 99.9% orange oil into odorless mineral spirits and vice versa. The mixtures were fully miscible. This produced a orange scented hydrocarbon based lighter fluid that is in part made with renewable recourses. This formulation also had a unique less offensive "chemical" odor.

The method of using the composition of the invention for igniting a barbecue or cooking fire comprises generally providing a lighter fluid having the composition described above, agitating the composition to ensure that it is in the form of an emulsion prior to use, applying the composition to charcoal, and igniting the composition after it has been applied to the charcoal. The lighter fluid is allowed to undergo complete or substantially complete combustion to leave a bed of hot coals suitable for cooking. The providing of the lighter fluid composition, as related in the above specific examples, generally comprises mixing the terpene, alcohol and surfactant together in a first container, mixing the water and thickening agent together in a second container, adding the combined water and thickening agent to the combined terpene, alcohol and surfactant, and then pH adjusting the combined mix to optimize the thickening provided by the thickening agent.

Accordingly, it will be seen that this invention provides a lighter fluid composition usable for starting barbecues and the like that comprises naturally occurring combustible materials, which is clean burning and results in low volatile organic compound (VOC) emission during combustion, which is biodegradable and easily disposable, and which burns with a pleasant aroma and does not impart unpleasant hydrocarbon odor or flavor to food cooked on a barbecue. Although the description above contains many specificities, these should not be construed as limiting the scope of the invention but as merely providing an illustration of the presently preferred embodiment of the invention. Thus the scope of this invention should be determined by the appended claims and their legal equivalents.

I claim:

1. A lighter fluid, comprising:

(a) between approximately 0.5 percent weight and approximately 90 percent weight of terpene;

(b) between approximately 0.5 percent weight and approximately 98.5 percent weight of alcohol, wherein said alcohol is replaced at least partially with aliphatic hydrocarbon;

(c) between approximately 0.5 percent weight and approximately 60 percent weight of water;

(d) between approximately 0.05 percent weight and approximately 10 percent weight of surfactant; and (e) between approximately 0.1 percent weight and approximately 10 percent weight of thickening agent, wherein said lighter fluid is an emulsion.

2. A method of starting a cooking fire without violating air quality standards, comprising:

providing a terpene-based lighter fluid;

starting a fire using said terpene-based lighter fluid; and emitting not more than more 0.020 pounds of volatile organic compounds during said step of starting a fire.

3. The method according to claim 2, wherein said lighter fluid is an emulsion.

4. The method according to claim 2, wherein said lighter fluid contains alcohol.

5. The method according to claim 2, wherein said lighter fluid contains an aliphatic hydrocarbon.

* * * * *